US009635960B2

(12) United States Patent
Mouyal

(10) Patent No.: US 9,635,960 B2
(45) Date of Patent: May 2, 2017

(54) APPARATUS FOR DISPLAYING GRAPHIC CONTENTS

(71) Applicant: Mordeckai Mouyal, Kfar Shmaryahoo (IL)

(72) Inventor: Mordeckai Mouyal, Kfar Shmaryahoo (IL)

( * ) Notice: Subject to any disclaimer, the term of this patent is extended or adjusted under 35 U.S.C. 154(b) by 0 days.

(21) Appl. No.: 15/200,075

(22) Filed: Jul. 1, 2016

(65) Prior Publication Data

US 2017/0000269 A1 Jan. 5, 2017

(30) Foreign Application Priority Data

Jul. 5, 2015 (IL) ..... 239779

(51) Int. Cl.
*G09F 1/00* (2006.01)
*A47G 1/06* (2006.01)

(52) U.S. Cl.
CPC ..... *A47G 1/0633* (2013.01)

(58) Field of Classification Search
CPC ..... G09B 1/28
USPC ..... 40/124.01, 124.06, 124.09, 124.19, 490, 40/491; 446/147, 151; 434/405
See application file for complete search history.

(56) References Cited

U.S. PATENT DOCUMENTS 7,325,341 B2 * 2/2008 Mouyal ..... G09F 1/00 40/124.01
7,363,738 B2 * 4/2008 Burtch ..... G09F 11/00 116/324
7,707,757 B2 * 5/2010 Crowell ..... G09F 11/30 40/490
8,322,058 B2 * 12/2012 Mayer ..... B42D 15/022 40/124.03

* cited by examiner

*Primary Examiner* — Joanne Silbermann

(57) ABSTRACT

A system for displaying graphic contents that comprises a permanent base that includes a first inner sliding member, which can move in and out. The system also includes a second inner sliding member that is inserted into the first inner sliding member, which can move in and out. The system also includes a third inner sliding member that is inserted into the second inner sliding member, which can move in and out.

3 Claims, 11 Drawing Sheets

APPARATUS FOR DISPLAYING GRAPHIC CONTENTS

FIELD OF THE INVENTION

The present invention relates to an apparatus for displaying pictures or graphic contents.

BACKGROUND ART

Many companies and various entities use folding, extractable or three-dimensional paper products to display pictures or graphic contents as part of advertising campaigns, marketing, and sales promotion activities. Over the years, a demand has arisen for such paper products with interesting and intricate designs. The present patent application refers to and describes an apparatus for displaying graphic contents that has an innovative and interesting design.

DESCRIPTION OF THE DRAWINGS

The intention of the drawings attached to the application is not to limit the scope of the invention and its application.

The drawings are intended only to illustrate the invention and they constitute only one of its many possible implementations.

THE INVENTION

Figure 1:
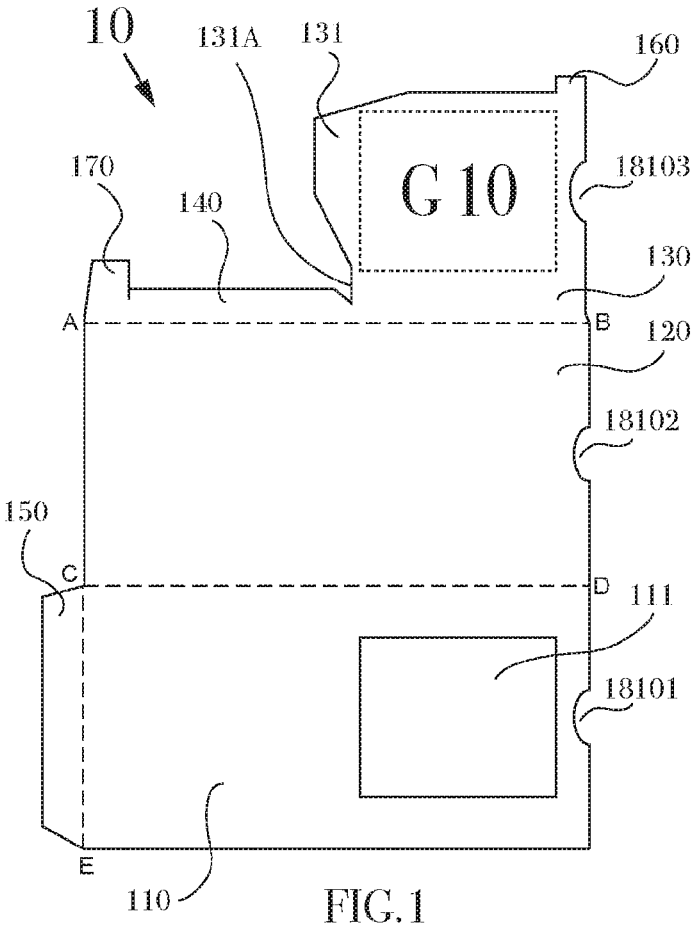
FIG. 1 depicts the permanent base (10) in layout state, before folding and pasting.

The apparatus for displaying graphics (100), subject of the present invention, comprises a permanent base (10) and a first inner sliding member (1). The first inner sliding member (1) is inserted into the permanent base (10) such that the first sliding member (1) can slide in and out of the permanent base (10). The system (100) can also include a second inner sliding member (2) that is inserted into the first inner sliding member (1) and can slide in and out of the first inner sliding member (1) or along with it as the first inner sliding member (1) slides in and out of the permanent base (1). The system (100) can further include a third inner sliding member (3) that is inserted into the second inner sliding member (2) and can slide in and out of the second inner sliding member (2) or along with it as the second inner sliding member (2) slides in and out of the first inner sliding member (1). The system (100) can, in fact, include multiple inner sliding members that are inserted into one another according to the same principle.

To describe the system (100) in a clearer manner, we will begin with a description and explanation of the structure of the third inner sliding member (3) and end with a description and explanation of the structure of the permanent base (10). We will also explain how each component is inserted into the previous component.

Figure 4:
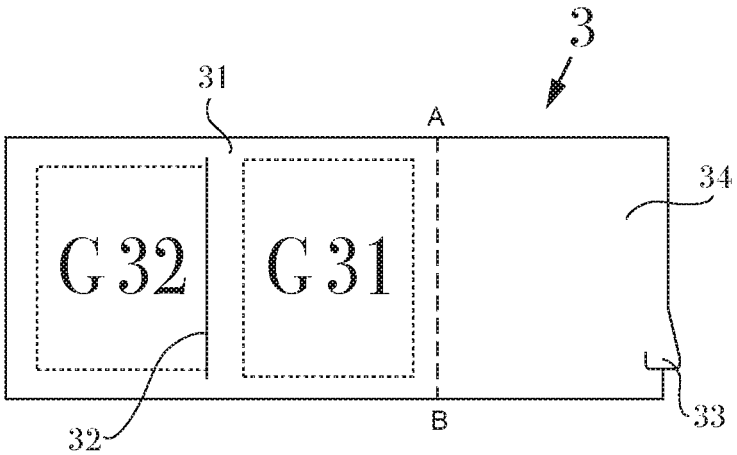
FIG. 4 depicts the third inner sliding member (3) in layout state, before folding and pasting.

FIG. 4 depicts the third inner sliding member (3) in layout state, before folding and pasting. This member (3) may be made of a single sheet of paper with a third graphics-bearing double panel (31) that consists of two sections (G31) (G32) that bear third graphic content, a third back panel (34), a vertical cut (32), a horizontal Folding line A-B, and a stopping means (33), which in the case depicted here is a protrusion (33).

Figure 5:
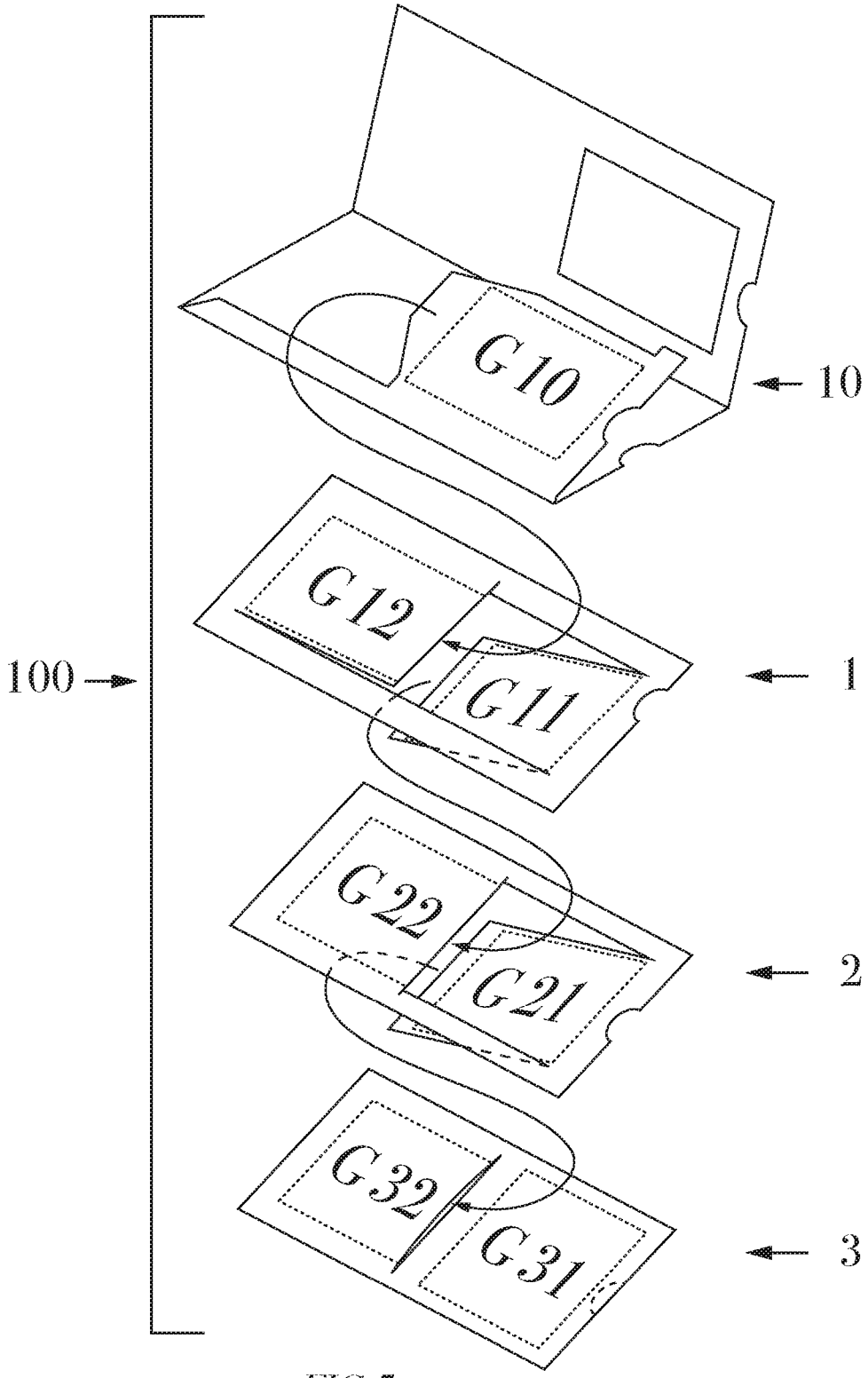
FIG. 5 depicts the permanent base (10), the first inner sliding member (1), the second inner sliding member (2), and the third inner sliding member (3) after each has been folded and pasted, but before being assembled together.

Folding, Pasting and Preparing the Third Inner Sliding Member (3):

The third back panel (34) is folded along the horizontal folding line A-B and is pasted over the back of the third graphics-bearing double panel (31). FIG. 5 depicts the components of the system (100) including the third inner sliding member (3).

Figure 3:
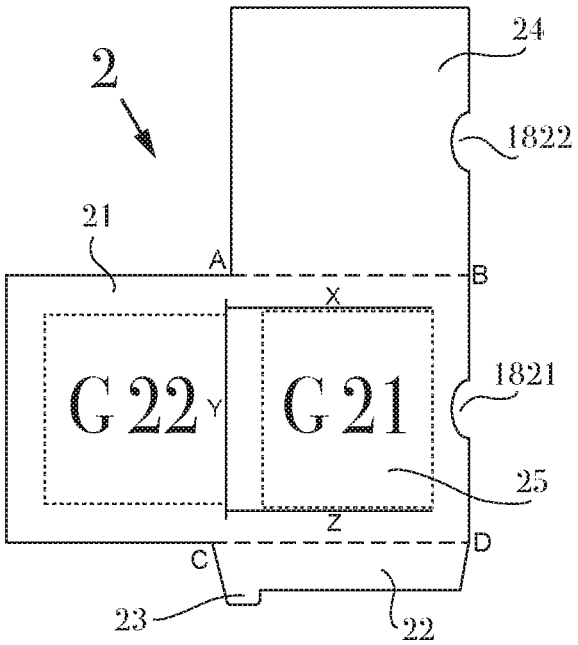
FIG. 3 depicts the second inner sliding member (2) in layout state, before folding and pasting.

FIG. 3 depicts the second inner sliding member (2) in layout state, before folding and pasting. This member (2) also has a second graphics-bearing double panel (21) that consists of two sections (G21) (G22) that bear second graphic content, a second bottom flange (22) that ends in a small step (23), a second back panel (24), two access cut-outs (1821) (1822), and two second folding lines A-B and C-D. The second double panel (21) has a second three-sided quadrangular cut, composed of second sides X, Y and Z, which forms a second flap (25).

Folding, Pasting and Preparing the Second Inner Sliding Member (2):

The second back panel (24) is folded along the second fold line A-B so that the second back panel (24) is parallel to the second double panel (21) and partially overlaps it. The second bottom flange (22) is folded up along second fold line C-D so that it partially overlaps the back of the second back panel (24). The step (23) serves to stop the third inner sliding member (3) when it is inserted into the second inner sliding member (2). In such case, the protrusion (33) on the third inner sliding member (3) encounters the step (23) on the second inner sliding member (2) and stops the insertion of the third inner sliding member (3) into the second inner sliding member (2). FIG. 5 presents a general description of the four components of the system (100) after folding and pasting, but before being assembled together.

Figure 2:
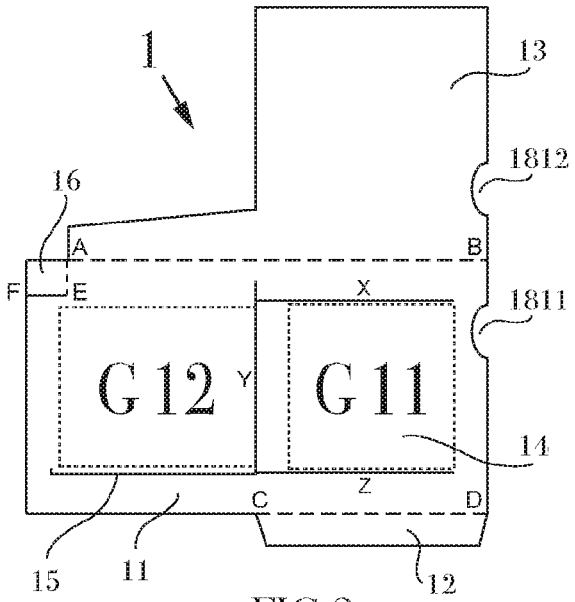
FIG. 2 depicts the first inner sliding member (1) in layout state, before folding and pasting.

FIG. 2 depicts the first inner sliding member (1) in layout state before folding and pasting. This member (1) has a first graphics-bearing double panel (11) that consists of two sections (G11) (G12) that bear graphic content, a first bottom flange (12), a first back panel (13), two access cut-outs (1821) (1822), and two first folding lines A-B and C-D. The first double panel (11) has a first three-sided quadrangular cut, composed of first sides X, Y and Z, which forms a first flap (14), and a first cut (15) that constitutes a direct continuation of said first side Z. The upper back corner of the first double panel (11) has a small flange (16) defined by the vertical folding line A-E and a horizontal cut E-F.

Folding, Pasting and Preparing the First Inner Sliding Member (1):

The first back panel (13) is folded along the first folding line A-B until it is parallel to the first double panel (11) and partially overlaps it. The first bottom flange (12) is folded up along the first folding line C-D so that it partially overlaps the back of the first back panel (13). The bottom of the folded first bottom flange (12) is pasted onto the back of the first back panel (13). The small flange (16) serves to stop the second inner sliding member (2) when it is inserted into the first inner sliding member (1).

FIG. 1 depicts the permanent base (10) in layout state, before folding and pasting. The permanent base (10) comprises a base front panel (110) with a front opening (111), a base back panel (120), a base graphics-bearing panel (130) with base graphic content (G10) and a stopping flange (131) with a stopping recess (A131), a base bottom flange (140), a back flange (150), an additional front stopping flange (160), a back stopping flange (170), three access cut-outs (18101) (18102) (18103), and three base folding lines A-B, C-D and E-C.

Folding, Pasting and Preparing the Permanent Base (10):

The base graphics-bearing panel (130) is folded along the base folding line A-B, so that it is parallel to the base front panel (110). In this position, the base graphics (G10) are visible through the front opening (111). The back flange (150) is folded along base folding line E-C and pasted onto the back of the base back panel (120), closing the back end of the permanent base (10) (this is done for aesthetic reasons only). The bottom of the base bottom flange (140) is pasted to the back of the base front panel (110). The back stopping flange (170) is pasted to the back of the base front panel (110), so that it may serve to stop the first inner sliding member (1) when it is inserted into the permanent base (10).

Figure 6:
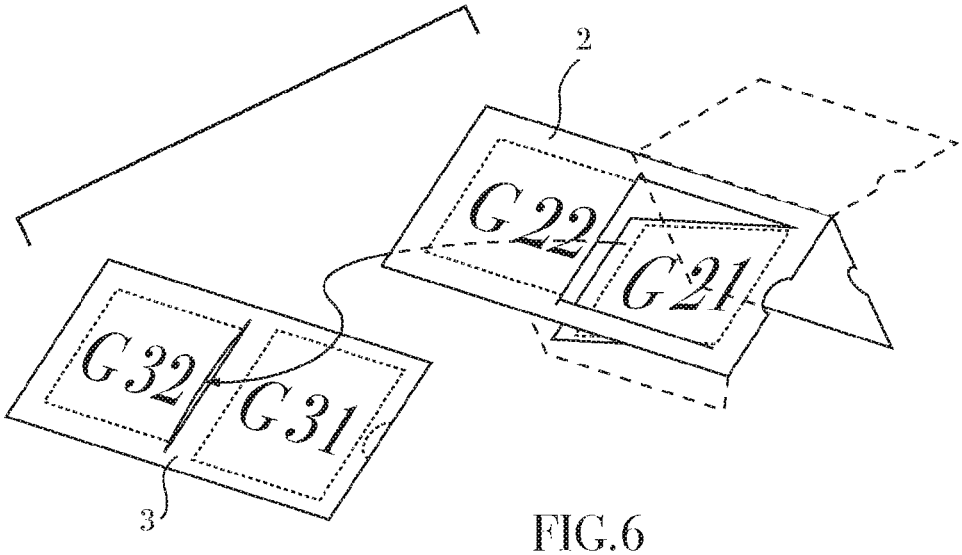
FIG. 6 depicts the third inner sliding member (3) and the second inner sliding member (2) separately, before being assembled together.
Figure 7A:
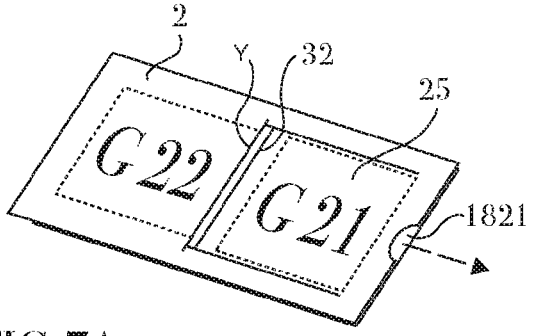
FIGS. 7A-7C depict several stages in the assembly of the third inner sliding member (3) into the second inner sliding member (2).
Figure 7B:
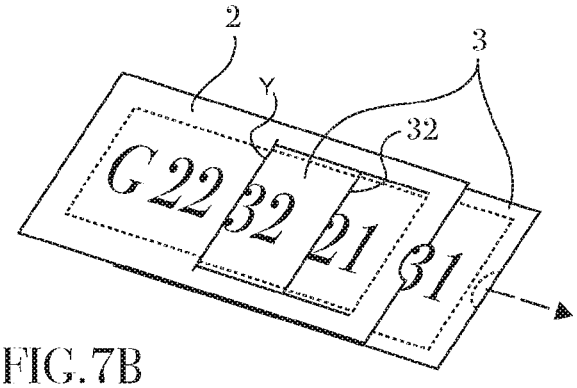
Figure 7C:
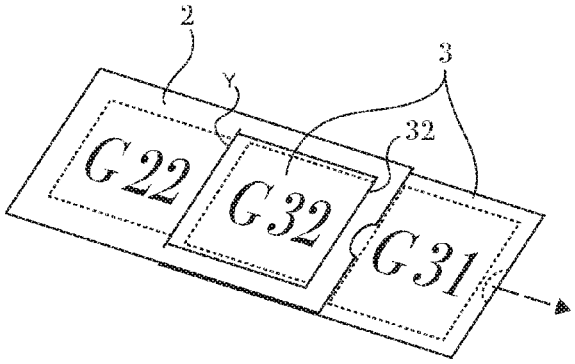

Assembling the Third Inner Sliding Member (3) into the Second Inner Sliding Member (2):

FIG. 6 depicts the third member (3) and the second member (2) separately, before they are assembled together. FIGS. 7A-7C show, in several steps, how the third inner sliding member (3) is assembled into the second inner sliding member (2). The third inner sliding member (3) is inserted into the second inner sliding member, and the second flap (25) on the second member (2) is inserted into the cut (32) so that when the third member (3) slides to the right, i.e. when it is pulled out, it is prevented from sliding all the way out of the second member (2) since the right-hand edge of the second flap (25) is stopped by the cut (32). When the third inner sliding member (3) is inserted into the second inner sliding member (2), it is stopped when the protrusion (33) encounters the step (23). The access cut-out (1821) on the second inner sliding member (2) enables access to the third inner sliding member (3), enabling the user to pull it out.

Figure 8:
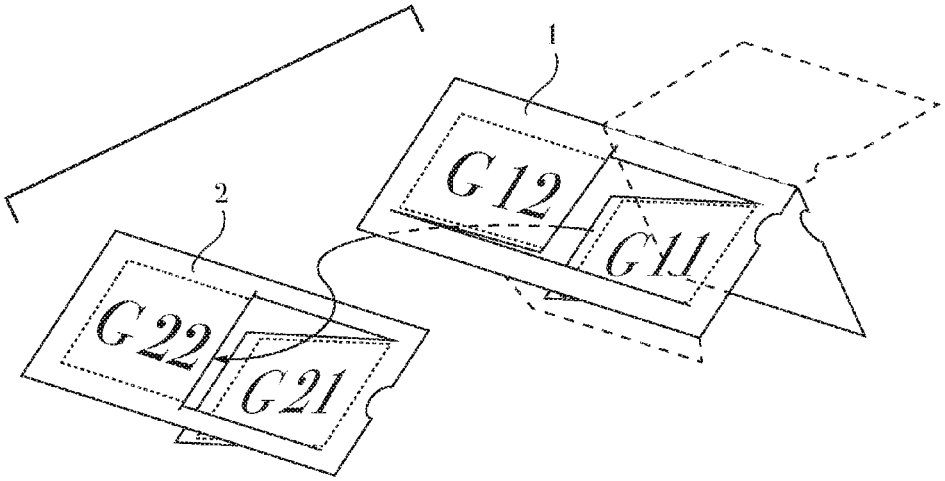
FIG. 8 depicts the second inner sliding member (2) and the first inner sliding member (1) separately, before being assembled together.

Assembling the Second Inner Sliding Member (2) into the First Inner Sliding Member (1):

FIG. 8 depicts the second inner sliding member (2) and the first inner sliding member (1) separately, before they are assembled together. FIGS. 9A-9D show, in several steps, how the second inner sliding member (2), with or without the third inner sliding member (3), is inserted into the first inner sliding member (1). The first flap (14) on the first member (1) is inserted into the second cut Y in the second member (2) so that when the second member (2) slides to, the right, i.e. when it is pulled out, it is prevented from sliding all the way out of the first member (1) since the right-hand edge of the first flap (14) on the first member (1) is stopped by the second cut Y in the second member (2). When the second inner sliding member (2) is inserted into the first inner sliding member (1), it is stopped when it encounters the small flange (16) on the first member (1). Here too, the access cut-outs (1821) (1913) in the first inner sliding member (1) enable access to the second member (2), enabling the user to pull it out.

Figure 10:
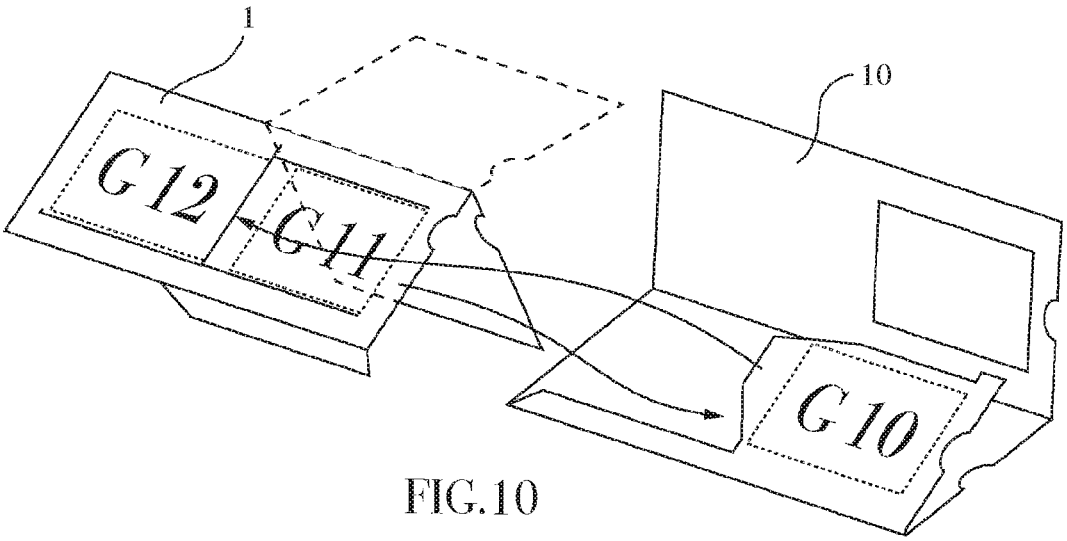
FIG. 10 depicts the first inner sliding member (1) and the permanent base (10) separately, before being assembled together.
Figure 11A:
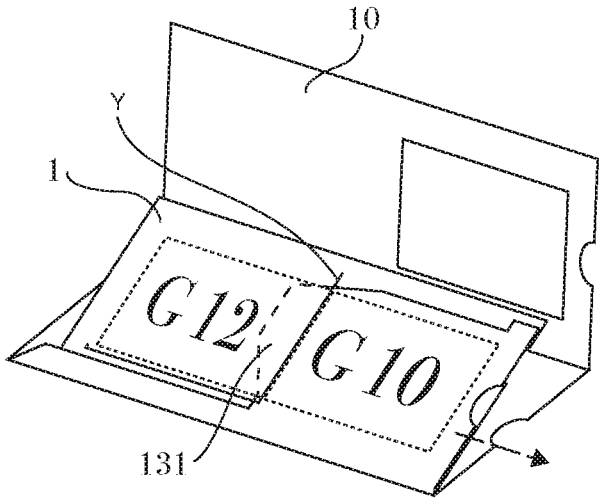
FIGS. 11A-11C depict several stages in the assembly of the first inner sliding member (1) into the permanent base (10).
Figure 11B:
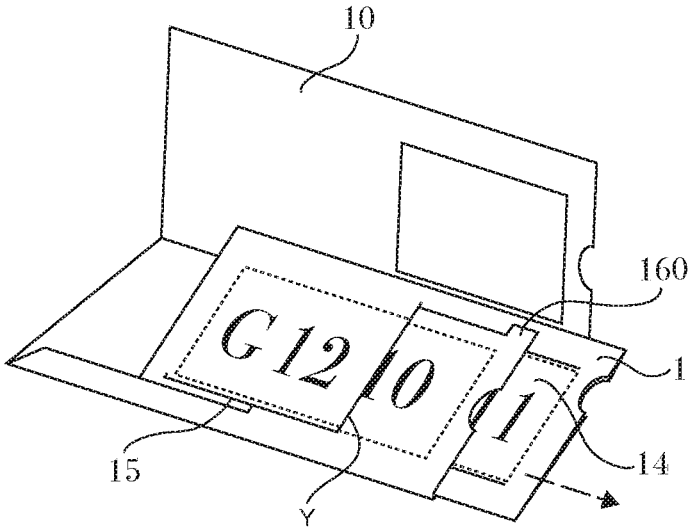
Figure 11C:
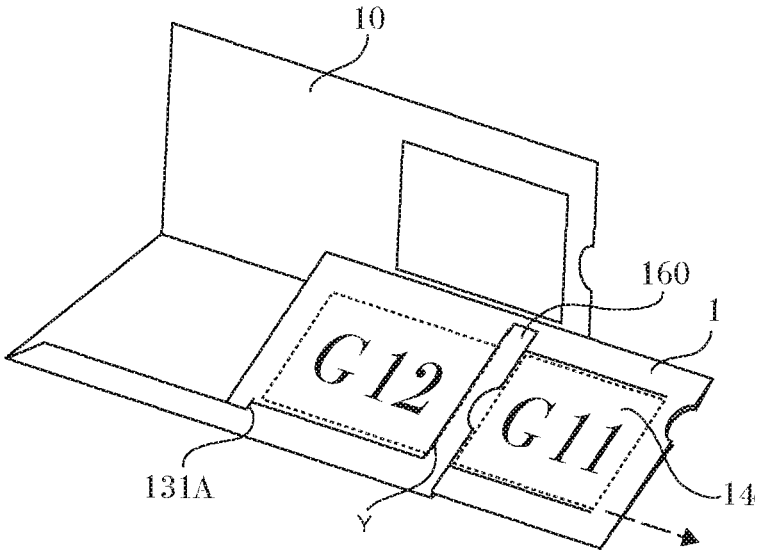

Assembling the First Inner Sliding Member (1) into the Permanent Base (10):

FIG. 10 depicts the first inner sliding member (1) and the permanent base (10) separately, before they are assembled together. FIGS. 11A-11C show, in several steps, how the first inner sliding member (1) is assembled, with or without the second and third inner sliding members, into the permanent base (10). The stopping flange (131) is inserted into the side Y in the first flap (14) so that when the first inner sliding member (1) slides to the right, i.e. when it is pulled out, it is prevented from sliding all the way out of the permanent base (10) since the front stopping flange (160) on the permanent base (10) is stopped by said side Y in the first inner sliding member (1) and/or the left edge of the first cut (15) is stopped by the stopping recess (131A) in the stopping flange (131). When the first inner sliding member (1) is inserted into the permanent base (10), it is stopped when it encounters the back stopping flange (170) on the permanent base (10). Here too, the access cut-outs (18101) (18102) (18103) in the permanent base (10) enable access to the first inner sliding member (1), enabling the user to pull it out.

Figure 12:
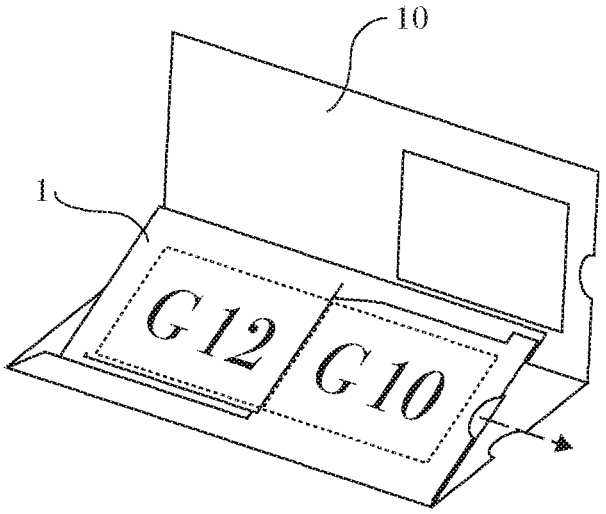
FIG. 12 depicts the first inner sliding member (1) integrated into the permanent base (10) in closed position.
Figure 13:
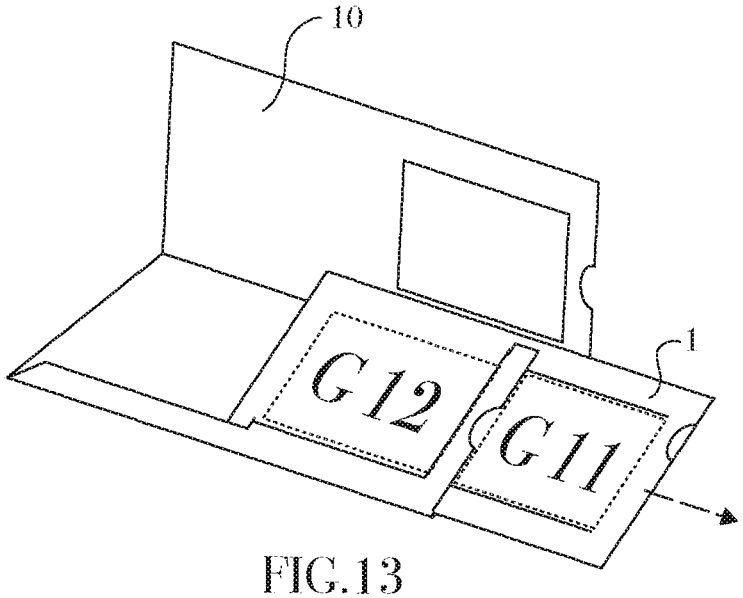
FIG. 13 depicts the first inner sliding member (1) integrated into the permanent base (10) in open position.
Figure 14:
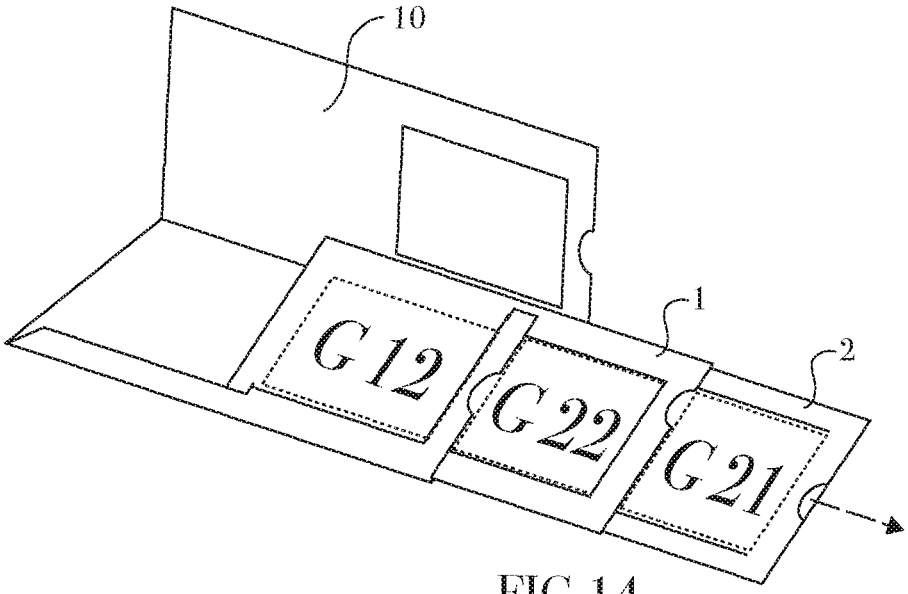
FIG. 14 depicts the first inner sliding member (1) and second inner sliding member (2) integrated into the permanent base (10) in open position.
Figure 15:
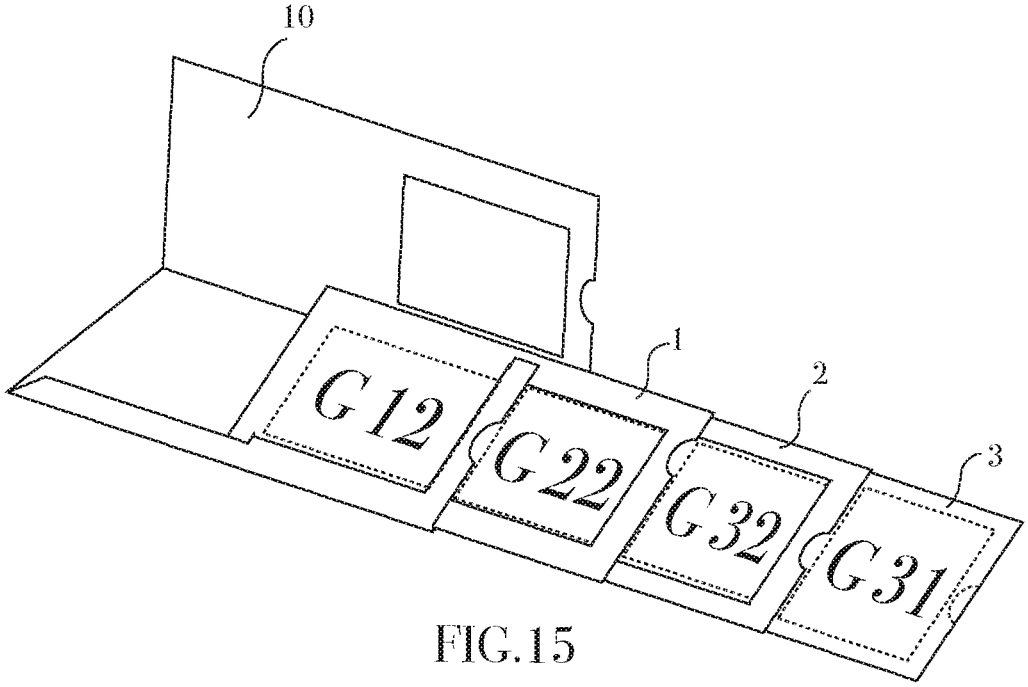
FIG. 15 depicts the first inner sliding member (1), the second inner sliding member (2), and the third inner sliding member (3) integrated into the permanent base (10) in open position.

FIG. 12 depicts the first inner sliding member (1) assembled into the permanent base (10) in closed position, while FIG. 13 depicts the first inner sliding member (1) integrated into the permanent base (10) in open position. FIG. 14 depicts the first inner sliding member (1) and second inner sliding member (2) assembled into the permanent base (10) in open position. FIG. 15 depicts the first inner sliding member (1), the second inner sliding member (2), and the third inner sliding member (3) assembled into the permanent base (10) in open position.

Figure 9A:
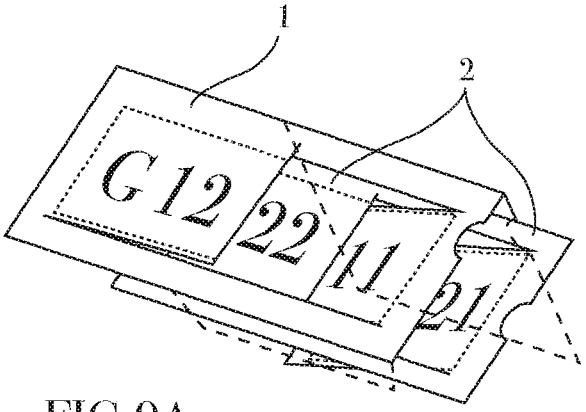
FIGS. 9A-9D depict several stages in the assembly of the second inner sliding member (2) into the first inner sliding member (1).
Figure 9B:
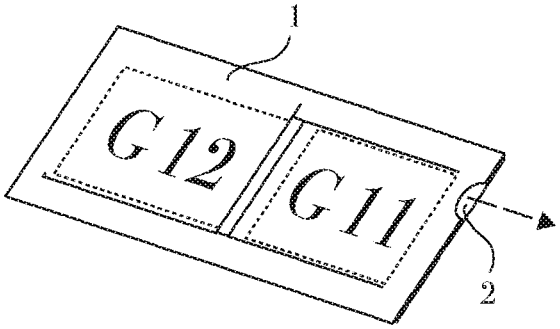
Figure 9C:
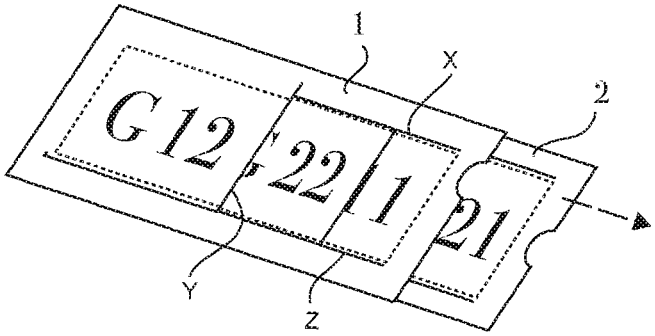
Figure 9D:
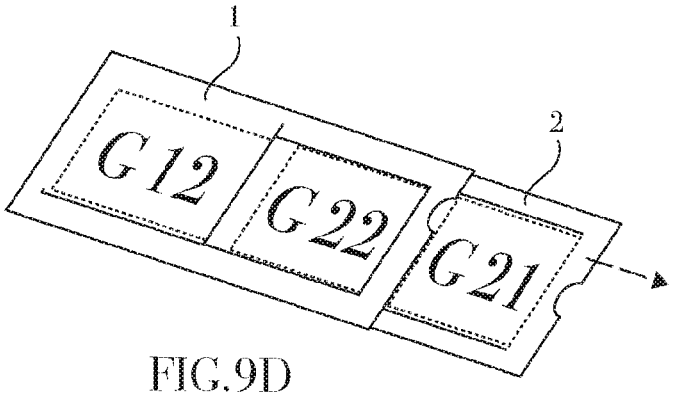

It is important to clarify several aspects of the system (100) described above and in the drawings: (a) The stopping flange (33) on the third inner sliding member (3) stops the third member (3) as it is inserted into the second inner sliding member (2), when it encounters the step (23) on second inner sliding member (2). (b) It is recommended that in closed position the cut (32) be positioned slightly to the left of the side Y so that the second flap (25) is not released when the system (100) is in closed position, as depicted in FIG. 7A. (c) The second flap (25) on the second inner sliding member (2) is larger than the first flap (14) on the first inner sliding member (1), so that the first flap (14) may be inserted through the cut along the vertical side of the second flap (25) without creating friction that might affect the opening of the system (100), as depicted in FIG. 9C. (d) The side Y in the first inner sliding member (1) (which, in fact, constitutes the vertical cut that creates the first flap (14)) continues upward slightly and is longer than the height of the first flap (14) so that the stopping flange (131) on the permanent base (10) can pass through the side Y. Thus, the front stopping flange (160) is stopped by the cut when in open position, as depicted in FIGS. 11B and 11C. In addition, the back panels of the inner sliding members are depicted in the drawings as being shorter than the double front panels for reasons of efficiency and in order to save paper space; they may, however, be of similar and even identical length to the length of the front panels.

What is claimed is:

1. A system for the presentation of graphic content comprising a permanent base and a first inner sliding member wherein the first inner sliding member is assembled into the permanent base and can slide in and out of it;

wherein the base consists of a base front panel with a front opening, a base back panel, a base graphics-bearing panel that bears base graphic content, a stopping flange with a stopping recess, a base bottom flange, a front stopping flange, and three base folding lines A-B, C-D, E-C; wherein the base graphics-bearing panel is folded along the base folding line A-B on the base back panel; wherein the base back panel is folded together with the base graphics-bearing panel along the base folding line C-D on the base front panel; and wherein the base bottom flange is folded and pasted to the base front panel;

wherein the first inner sliding member consists of a first double graphics-bearing panel with two sections that bear first graphic content, a first bottom flange, a first back panel, two access cut-outs, and two first folding lines A-B and C-D; wherein the first double graphics-bearing panel has a first three-sided quadrangular cut composed of first sides X, Y, and Z that forms a first flap; wherein the first double graphics-bearing panel has a first cut that constitutes a direct continuation of the first side Z; wherein the first back panel is folded along the first folding line A-B so that the first back panel is parallel to and overlaps the first double graphics-bearing panel; wherein the first bottom flange is folded along the first folding line C-D and pasted to the back of the first back panel;

whereby the first inner sliding member is inserted into the base, whereby the stopping flange is inserted into the side Y of the first cut in the first flap so that when the first inner sliding member is slid out of the base it is prevented from sliding all the way out of the base since said first cut Y in the first inner member is stopped by the front stopping flange in the base or the left edge of the first cut is stopped by the stopping recess.

2. The system for presenting graphic content of claim 1 further comprising a second inner sliding member wherein the second inner sliding member is inserted into and slides in and out of said first inner sliding member;

wherein the second inner sliding member consists of a second double graphics-bearing panel with two sections that bear second graphic content, a second bottom flange, a second back panel, and two second folding lines A-B and C-D; wherein the second double graphics-bearing panel has a second three-sided quadrangular cut composed of second sides X, Y and Z which forms a second flap, whereby the second back panel is folded along second fold line A-B over the second double graphics-bearing panel, and the second bottom flange is folded along second folding line C-D and pasted to the back of the second back panel;

whereby the second inner sliding member is inserted into the first inner sliding member and the first flap on the first inner sliding member is inserted into the second cut Y in the second inner sliding member so that when the second inner sliding member is slid out of the first inner sliding member it is prevented from sliding all the way out of the first inner sliding member since the second cut Y in the second inner sliding member is stopped by the right-hand edge of the first flap on the first inner sliding member.

3. The system for presenting graphic content of claim 2 further comprising a third inner sliding member wherein the third inner sliding member is inserted into and slides in and out of said second inner sliding member;

wherein the third inner sliding member consists of a third double graphics-bearing panel with two sections that bear third graphic content, a third back panel, a vertical cut, and a horizontal folding line A-B, whereby the third back panel is folded along the horizontal folding line A-B and pasted to the back of the third double graphics-bearing panel;

whereby the third inner sliding member is inserted into the second inner sliding member and the second flap is inserted into the vertical cut so that when the third inner sliding member is slid out of the second inner sliding member the third inner sliding member is prevented from sliding all the way out of the second inner sliding member since the vertical cut is stopped by the right-hand edge of the second flap.

* * * * *